US008997623B2

(12) United States Patent
Pflaumer et al.

(10) Patent No.: US 8,997,623 B2
(45) Date of Patent: Apr. 7, 2015

(54) TWO-PIECE LOCKING BLOCK DEVICE

(75) Inventors: Wulf-Heinz Pflaumer, Arnsberg (DE); Franz Wonisch, Arnsberg (DE); Martin Werner, Langenau (DE)

(73) Assignee: Carl Walther GmbH, Ulm (DE)

( * ) Notice: Subject to any disclaimer, the term of this patent is extended or adjusted under 35 U.S.C. 154(b) by 167 days.

(21) Appl. No.: 13/606,134

(22) Filed: Sep. 7, 2012

(65) Prior Publication Data

US 2013/0061501 A1 Mar. 14, 2013

(30) Foreign Application Priority Data

Sep. 8, 2011 (DE) ..... 10 2011 114 038

(51) Int. Cl.
*F41A 3/54* (2006.01)
*F41A 3/12* (2006.01)

(52) U.S. Cl.
CPC ..... *F41A 3/12* (2013.01)

(58) Field of Classification Search
USPC ..... 42/75.02, 2, 14–22, 25, 16.1; 89/194–196, 183
See application file for complete search history.

(56) References Cited

U.S. PATENT DOCUMENTS

| | | | | |
|---|---|---|---|---|
| 5,765,302 | A | 6/1998 | Brandl et al. | |
| 6,276,252 | B1 * | 8/2001 | Dionne | 89/29 |
| 6,289,782 | B1 * | 9/2001 | Watson, Jr. | 89/37.01 |
| 6,357,331 | B1 | 3/2002 | Dionne | |
| 6,789,342 | B2 * | 9/2004 | Wonisch et al. | 42/75.02 |
| 2002/0116857 | A1 * | 8/2002 | Wonisch et al. | 42/75.02 |

FOREIGN PATENT DOCUMENTS

DE 8232810 U1 6/1983

* cited by examiner

*Primary Examiner* — Jonathan C Weber
(74) *Attorney, Agent, or Firm* — Bachman & LaPointe, P.C.

(57) ABSTRACT

A locking block device (100) provided in the region of a cartridge chamber (121) of a handgun barrel (120) has a locking block (110) for releasably locking the barrel (120) to a breech prior to firing, and has a control member (111) having a control guide (112) for swinging out the barrel (120), after firing, for the purpose of separating the barrel (120) from the breech, and further has a feed ramp (140) formed in the region of a stop member (130) of the locking block (110) for feeding a cartridge, stored in a magazine of the handgun, into the cartridge chamber (121) following ejection of a fired cartridge. A modular design capable of being adapted to meet specific requirements is achieved in that the feed ramp (140) is formed on a ramp member (150) capable of being separated from the locking block (110) and releasably locked to the locking block (110).

18 Claims, 2 Drawing Sheets

TWO-PIECE LOCKING BLOCK DEVICE

BACKGROUND OF THE INVENTION

The invention relates to a locking block device provided in the region of a cartridge chamber of a handgun barrel and comprising a locking block for releasably locking the gun barrel to a breech prior to firing the handgun and comprising a control member having a control guide for swinging out the gun barrel, after the handgun has been fired, for the purpose of separating the gun barrel from the breech, and further comprising a feed ramp provided in the region of a stop member of the locking block for the purpose of feeding a cartridge, stored in a magazine of the handgun, into the cartridge chamber of the gun barrel following ejection of a fired cartridge.

Locking block devices of the above type are used in the prior art in order to lock a gun barrel firmly to a breech prior to firing the handgun, whereupon the gun barrel and the breech first move jointly in the direction counter to the projectile's motion directly after the handgun has been fired, and this joint movement of the gun barrel and the breech is followed by separation of the gun barrel from the breech due to an unlocking action of the gun barrel, in order to bring the gun barrel into a position in which a cartridge can be fed from the magazine of the handgun into the cartridge chamber.

However, a disadvantage of the locking block devices known in the prior art is that, for reasons of achieving the required robustness, they have to be fabricated integrally with a gun barrel in a process that consumes labor and material.

Another disadvantage of the prior locking block devices is the inability to customize the locking block and particularly the feed ramp of the locking block for feeding cartridges from a magazine into the cartridge chamber of the gun barrel, as would be desirable for various applications. Thus the feed ramp cannot be adapted to suit cartridges of various shapes and calibers.

SUMMARY OF THE INVENTION

It is therefore an object of the invention to provide a locking block device that is of a modular design and is capable of being adapted to meet specific requirements.

For a locking block device of the above type, this object is achieved, according to the invention, in that the feed ramp is provided on a ramp member that is capable of being separated from the locking block and that is releasably locked to the locking block.

Preferred embodiments of the invention are the subject-matter of the sub-claims.

In the locking block device of the invention, the combination of features encompassing the provision of a feed ramp on a ramp member that is capable of being separated from the locking block and that is releasably locked to the locking block makes it possible to connect ramp members of various shapes and dimensions to a given locking block so as to form a fixed functional unit.

According to a first preferred embodiment of the device of the invention, the cartridge chamber of the gun barrel is provided with an external screw thread, and the locking block comprises a bore having an internal screw thread that is complementary to the external screw thread of the cartridge chamber such that the locking block is capable of being screwed firmly onto the gun barrel.

According to another preferred embodiment of the device of the invention, the gun barrel is provided with a flange in the region of its end remote from the muzzle, which flange forms a latching element for a locking block screwed onto the gun barrel, a peripheral groove being provided between the external screw thread of the cartridge chamber and the flange.

Preferably, the ramp member comprises a pin that can closely engage in a plug-in bore provided in the region of the stop member in the locking block. Preferably, the plug-in bore is oriented in a direction parallel to the center axis of the gun barrel.

According to a significant preferred embodiment of the device of the invention, provision is made for the ramp member to comprise a protrusion that is capable of engaging the peripheral groove on the gun barrel.

When the ramp member is firmly attached to the locking block, the peripheral groove on the gun barrel then engages with a notch provided between the protrusion and a top region of the feed ramp near to the flange on the gun barrel.

Preferably, a recess is further provided in the stop member for the purpose of accommodating the protrusion.

When the ramp member is firmly attached to the locking block, the top region of the feed ramp near to the gun barrel is then preferably located then in the vicinity of the cartridge chamber.

BRIEF DESCRIPTION OF THE DRAWINGS

The device of the invention is explained below with reference to a preferred embodiment illustrated in the figures of the drawings, in which.

DETAILED DESCRIPTION

Figure 1:
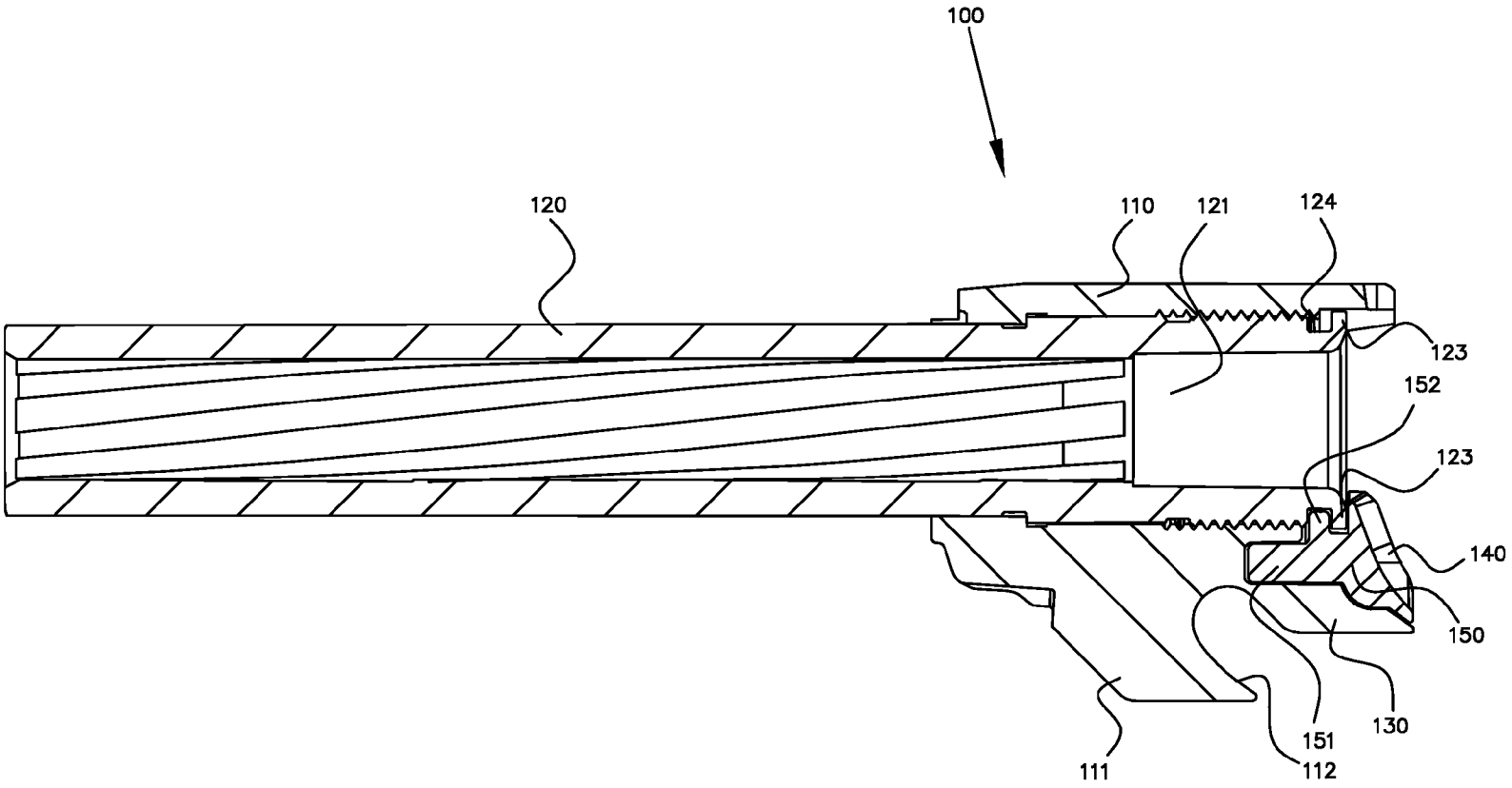
FIG. 1 is a cross-sectional view of a preferred embodiment of the device of the invention.
Figure 2:
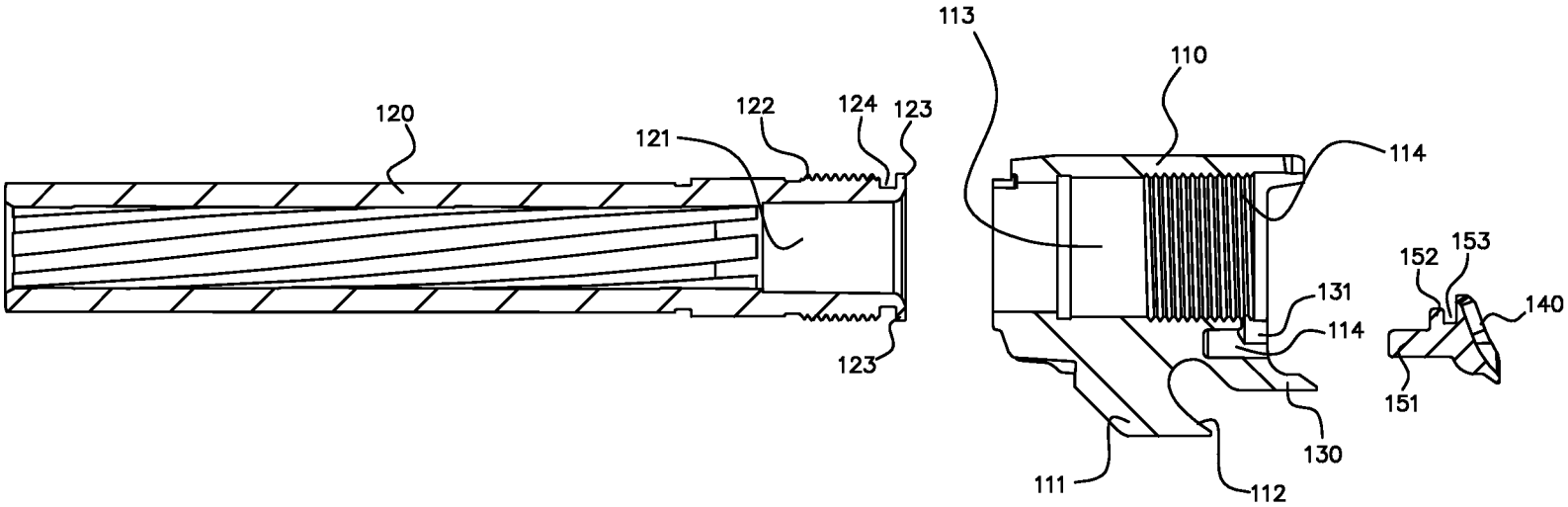
FIG. 2 is a further cross-sectional view of the preferred embodiment of the device of the invention as shown in FIG. 1.

The locking block device 100 of the invention shown in FIGS. 1 and 2 is disposed in the region of a cartridge chamber of a gun barrel and comprises a locking block for releasably locking the gun barrel to a breech prior to firing the handgun.

The locking block 110 comprises a control member 111 comprising a control guide 112 for swinging out the gun barrel 120 after firing the handgun, in order to enable the gun barrel 120 to be separated from the breech.

Furthermore, the locking block 110 comprises a feed ramp 140 that is provided in the region of a stop member 130 of the locking block 110 for feeding a cartridge stored in a magazine of the handgun into the cartridge chamber 121 of the gun barrel 120 following the ejection of a fired cartridge, and the feed ramp 140 is provided on a ramp member 150 that is capable of being separated from the locking block 110 and that is releasably locked to the locking block 110.

The cartridge chamber 121 of the gun barrel 120 is provided with an external screw thread 122, and the locking block 110 comprises a bore 113 having an internal screw thread 114 that is complementary to the external screw thread 122 on the cartridge chamber such that the locking block is capable of being firmly screwed onto the gun barrel 120.

The gun barrel 120 is provided with a flange 123 in the region of its end remote from the muzzle, which flange 123 forms a latching element for a locking block 110 screwed onto the gun barrel, a peripheral groove 124 being provided between the external screw thread 122 on the cartridge chamber and the flange 123.

The ramp member 150 comprises a pin 151 that can closely engage in a plug-in bore 114 provided in the region of the stop member 130 in the locking block 110. The plug-in bore 114 is oriented in a direction parallel to the center axis of the gun barrel 120.

The ramp member 150 further comprises a protrusion 152 that is capable of engaging with the peripheral groove 124 on the gun barrel 120. When the ramp member 150 is firmly attached to the locking block 110, the peripheral groove 124 on the gun barrel 120 engages with a notch 153 provided between the protrusion 152 and a top region of the feed ramp 140 near to the flange 123 on the gun barrel 120.

A recess 131 is provided in the stop member 130 for accommodation of the protrusion 152 so that the ramp member 150 is located inside the locking block 110 with the exception of the feed ramp 140.

When the ramp member 150 is firmly attached to the locking block 110, the top region of the feed ramp 140 near to the gun barrel 120 is then located in the vicinity of the cartridge chamber 121.

The embodiment of the present invention described above serves only the purpose of providing a better understanding of the teaching of the invention defined in the claims, which is not, as such, restricted to said embodiment.

What is claimed is:

1. A locking block device (100) formed in the region of a cartridge chamber (121) of a handgun barrel (120) and comprising:

a locking block (110) for the purpose of releasably firmly connecting the handgun barrel (120) to a breech prior to firing the handgun, and comprising:

a control member (111) having a control guide (112) for the purpose of swinging out the handgun barrel (120) after the handgun has been fired, for the purpose of separating the handgun barrel (120) from the breech; and a ramp member (150) comprising:

a feed ramp (140) formed on the ramp member in a region of a stop member (130) of the locking block (110) for the purpose of feeding a cartridge stored in a magazine of the handgun into the cartridge chamber (121) of the handgun barrel (120) following ejection of a fired cartridge characterized in that:

said ramp member (150) is releasably locked to said locking block (110);

said cartridge chamber (121) of said handgun barrel (120) is provided with an external screw thread (122) and said locking block (110) has a bore (113) exhibiting an internal screw thread (114) that is complementary to said external screw thread (122) on said cartridge chamber such that said locking block (110) is capable of being firmly screwed onto said handgun barrel (120); and the handgun barrel (120) is provided with a flange (123) in the region of its end remote from the muzzle, which flange forms a latching device for a screwed on locking block (110), a peripheral groove (124) being provided between said external screw thread (122) of said cartridge chamber and said flange (123).

2. The device as defined in claim 1, characterized in that said ramp member (150) comprises a pin (151), which closely engages a plug-in bore (114) formed in the region of said stop member (130) in said locking block (110).

3. The device as defined in claim 2, characterized in that said plug-in bore (114) is oriented in a direction parallel to the center axis of said handgun barrel (120).

4. The device as defined in claim 3, characterized in that said ramp member (150) comprises a projection that is capable of engaging said peripheral groove (124) on said handgun barrel (120).

5. The device as defined in claim 4, characterized in that when said ramp member (150) is firmly attached to said locking block (110), said peripheral groove (124) on said handgun barrel (120) engages a notch (153) formed between said projection (152) and an upper region of said feed ramp (140) near to said flange (123) on said handgun barrel (120).

6. The device as defined in claim 5, characterized in that in the stop member (130) a recess (131) is formed for the accommodation of said projection (152).

7. The device as defined in claim 6, characterized in that when said ramp member (150) is firmly attached to said locking block (110), the top region of said feed ramp (140) near to said handgun barrel (120) is then in the vicinity of said cartridge chamber (121).

8. The device as defined in claim 5, characterized in that when said ramp member (150) is firmly attached to said locking block (110), the top region of said feed ramp (140) near to said handgun barrel (120) is then in the vicinity of said cartridge chamber (121).

9. The device as defined in claim 4, characterized in that when said ramp member (150) is firmly attached to said locking block (110), the top region of said feed ramp (140) near to said handgun barrel (120) is then in the vicinity of said cartridge chamber (121).

10. The device as defined in claim 4, characterized in that in the stop member (130) a recess (131) is formed for the accommodation of said projection (152).

11. The device as defined in claim 2, characterized in that said ramp member (150) comprises a projection that is capable of engaging said peripheral groove (124) on said handgun barrel (120).

12. The device as defined in claim 11, characterized in that when said ramp member (150) is firmly attached to said locking block (110), said peripheral groove (124) on said handgun barrel (120) engages a notch (153) formed between said projection (152) and an upper region of said feed ramp (140) near to said flange (123) on said handgun barrel (120).

13. The device as defined in claim 12, characterized in that in the stop member (130) a recess (131) is formed for the accommodation of said projection (152).

14. The device as defined in claim 13, characterized in that when said ramp member (150) is firmly attached to said locking block (110), the top region of said feed ramp (140) near to said handgun barrel (120) is then in the vicinity of said cartridge chamber (121).

15. The device as defined in claim 1, characterized in that said ramp member (150) comprises a projection that is capable of engaging said peripheral groove (124) on said handgun barrel (120).

16. The device as defined in claim 15, characterized in that when said ramp member (150) is firmly attached to said locking block (110), said peripheral groove (124) on said handgun barrel (120) engages a notch (153) formed between said projection (152) and an upper region of said feed ramp (140) near to said flange (123) on said handgun barrel (120).

17. The device as defined in claim 16, characterized in that in the stop member (130) a recess (131) is formed for the accommodation of said projection (152).

18. The device as defined in claim 17, characterized in that when said ramp member (150) is firmly attached to said locking block (110), the top region of said feed ramp (140) near to said handgun barrel (120) is then in the vicinity of said cartridge chamber (121).

* * * * *